US007433616B2

(12) United States Patent
Nishida et al.

(10) Patent No.: US 7,433,616 B2
(45) Date of Patent: Oct. 7, 2008

(54) IMAGE FORMING APPARATUS INCLUDING A CONTROLLING SECTION

(75) Inventors: Satoshi Nishida, Saitama (JP); Shigetaka Kurosu, Hino (JP); Kazuteru Ishizuka, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 312 days.

(21) Appl. No.: 11/281,483

(22) Filed: Nov. 18, 2005

(65) Prior Publication Data

US 2006/0188276 A1 Aug. 24, 2006

(30) Foreign Application Priority Data

Feb. 23, 2005 (JP) ..... 2005-046821

(51) Int. Cl.
*G03G 15/00* (2006.01)

(52) U.S. Cl. ..... 399/49; 399/51; 399/55; 399/66

(58) Field of Classification Search ..... 399/49, 399/55, 66, 51
See application file for complete search history.

(56) References Cited

U.S. PATENT DOCUMENTS 5,983,044 A * 11/1999 Kodama et al. ..... 399/49

FOREIGN PATENT DOCUMENTS

| | | | |
|---|---|---|---|
| JP | 9-218598 | | 8/1997 |
| JP | 10288879 | A * | 10/1998 |
| JP | 2002-244369 | | 8/2002 |
| JP | 2003-241544 | | 8/2003 |

* cited by examiner

*Primary Examiner*—David M. Gray
*Assistant Examiner*—Ryan D Walsh
(74) *Attorney, Agent, or Firm*—Finnegan, Henderson, Farabow, Garrett & Dunner, L.L.P.

(57) ABSTRACT

There is disclosed an image forming apparatus includes an image bearing member; a charging device to charge the image bearing member; an exposing device to form a latent image on the image bearing member; a developing device to form a toner image on the image bearing member; a transferring device to transfer the toner image onto an intermediate transfer member by applying a transfer bias voltage; an image stabilization controlling section for keeping a density of the toner image transferred onto the intermediate transfer member within a predetermined range; a transfer output controlling section for controlling a transfer output based on a density of a toner patch image; and an overall controlling section to control both the image stabilization controlling section and the transfer output controlling section, in such a manner that the image stabilization controlling operation is conducted preceding to the transfer output controlling operation.

8 Claims, 7 Drawing Sheets

IMAGE FORMING APPARATUS INCLUDING A CONTROLLING SECTION

This application is based on Japanese Patent Application NO. 2005-046821 filed on Feb. 23, 2005 in Japanese Patent Office, the entire content of which is hereby incorporated by reference.

BACKGROUND OF THE INVENTION

This invention relates to an image forming apparatus such as a copier and a laser beam printer, and in particular relates to an image forming apparatus for conducting a transfer output control operation.

The schematic structure of conventional image forming apparatuses will be described with reference to FIG. 7. Such an image forming apparatus has image forming devices 10Y, 10M, 10C, and 10K which form the images of the colors yellow, magenta, cyan and black respectively, and these have photoreceptor drums 1Y, 1M, 1C and 1K respectively which are image bearing members, and each photoreceptor drum rotates in the direction of the arrow (anticlockwise). Charging devices 2Y, 2M, 2C and 2K, exposing devices 3Y, 3M, 3C and 3K, developing devices 4Y, 4M, 4C and 4K, and cleaners 8Y, 8M, 8C and 8K are sequentially arranged on the periphery of the photoreceptor drums 1Y, 1M, 1C and 1K respectively in the direction of rotation thereof. The images formed on the photoreceptor drum using the developing agent in each image forming device are sequentially transferred by each of the first transfer rollers 7Y, 7M, 7C and 7K which are transfer devices, onto the belt-like intermediate transfer member 6 which moves and passes adjacent to the photoreceptor drum. The images that are transferred onto the intermediate transfer member 6 are further transferred to the recording material P such as paper at the second transfer roller 73.

In this image forming apparatus, such changes as in the properties of the transfer roller and the intermediate transfer member that are used, the physical properties of the toner, and the properties of the photoreceptor due to environmental changes and the passage of time sometimes cause changes in image density. Such an image forming apparatus generally has a mechanism for adjusting image density, and many have devices which automatically adjust their image density to an optimum level. In particular, in an image forming device which performs full color image output, more accurate control of yellow, magenta, cyan and black respectively is required in order to obtain a desirable color balance. Examples of the background technology are described in the following.

A technology has been disclosed wherein the transfer bias is obtained from the developing bias value and control is thereby performed. More specifically, the developing bias is obtained based on the density of the toner patch image, and also the relationship between the developing bias and the transfer bias is determined in advance and the transfer bias is obtained using this relationship, from the obtained developing bias (See Patent Document 1).

A technology has been disclosed wherein, in the case where control is conducted by increasing or decreasing the charge amount per unit area of the toner image on the image bearing member, the transfer bias is subsequently reset by the transfer bias setting device (See Patent Document 2).

A technology has been disclosed in which the toner patch image is formed on the image bearing member, and the transfer bias is determined based on detection of the density of the toner patch image that was transferred onto the intermediate transfer member from the image bearing member (See Patent Document 3).

[Patent Document 1]
Tokkai 2002-244369 (Japanese Non-Examined Patent Publication)
[Patent Document 2]
Tokkai 2003-241544 (Japanese Non-Examined Patent Publication)
[Patent Document 3]
Tokkaihei 09-218598 (Japanese Non-Examined Patent Publication)

However, the background technologies described above have the following problems.

In Patent Document 1, it is known that properties such as of the transfer roller and the intermediate transfer member change due to environmental changes and the passage of time. When these changes occur, the aforementioned relationship that is obtained in advance between the developing bias and the transfer bias sometimes changes, and thus a problem arises in that it is difficult to accurately determine the transfer bias.

In Patent Document 2, the charge amount per unit area of the toner image on the image bearing member must be adjusted, and also the transfer output must be set and thus control is difficult. In addition, even when the transfer output is reset, it is simply obtained from the relationship data for voltage/current values, and the density of the actual toner image is not detected and thus there is a problem in that obtaining accurate transfer output is difficult.

In the Patent Document 3, when the transfer output value is adjusted, if the developing bias or the laser beam intensity or other values change, it becomes impossible to keep the density of the toner image on the intermediate transfer member within a fixed range, and there is a problem in that in this state, from the density of the toner patch image that was transferred to the intermediate transfer member, obtaining accuracy transfer output is difficult.

SUMMARY OF THE INVENTION

This invention was conceived in view of the above-described problems. To overcome the abovementioned drawbacks in conventional image forming apparatus, it is an object of the present invention to provide an image forming apparatus which can accurately determine the transfer output, and in particular, even if there are changes such as in the properties of the transfer roller and the intermediate transfer member that are used, in the physical properties of the toner, and in the properties of the photoreceptor due to environmental changes and the passage of time, the transfer output can be accurately obtained and high quality images can be output.

Accordingly, to overcome the cited shortcomings, the abovementioned object of the present invention can be attained by image forming apparatus described as follow.

(1) An apparatus for forming an image, comprising:

an image bearing member;

a charging device to charge the image bearing member;

an exposing device to expose the image bearing member charged by the charging device so as to form a latent image on the image bearing member;

a developing device to develop the latent image so as to form a toner image on the image bearing member;

a transferring device to transfer the toner image onto an intermediate transfer member at a transferring section by applying a transfer bias voltage outputted by a power source;

an image stabilization controlling section to conduct an image stabilization controlling operation for keeping a density of the toner image transferred onto the intermediate transfer member within a predetermined range;

a transfer output controlling section to conduct a transfer output controlling operation for controlling a transfer output based on a density of a toner patch image formed on the intermediate transfer member; and an overall controlling section to control both the image stabilization controlling section and the transfer output controlling section, in such a manner that the image stabilization controlling operation is conducted preceding to the transfer output controlling operation.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
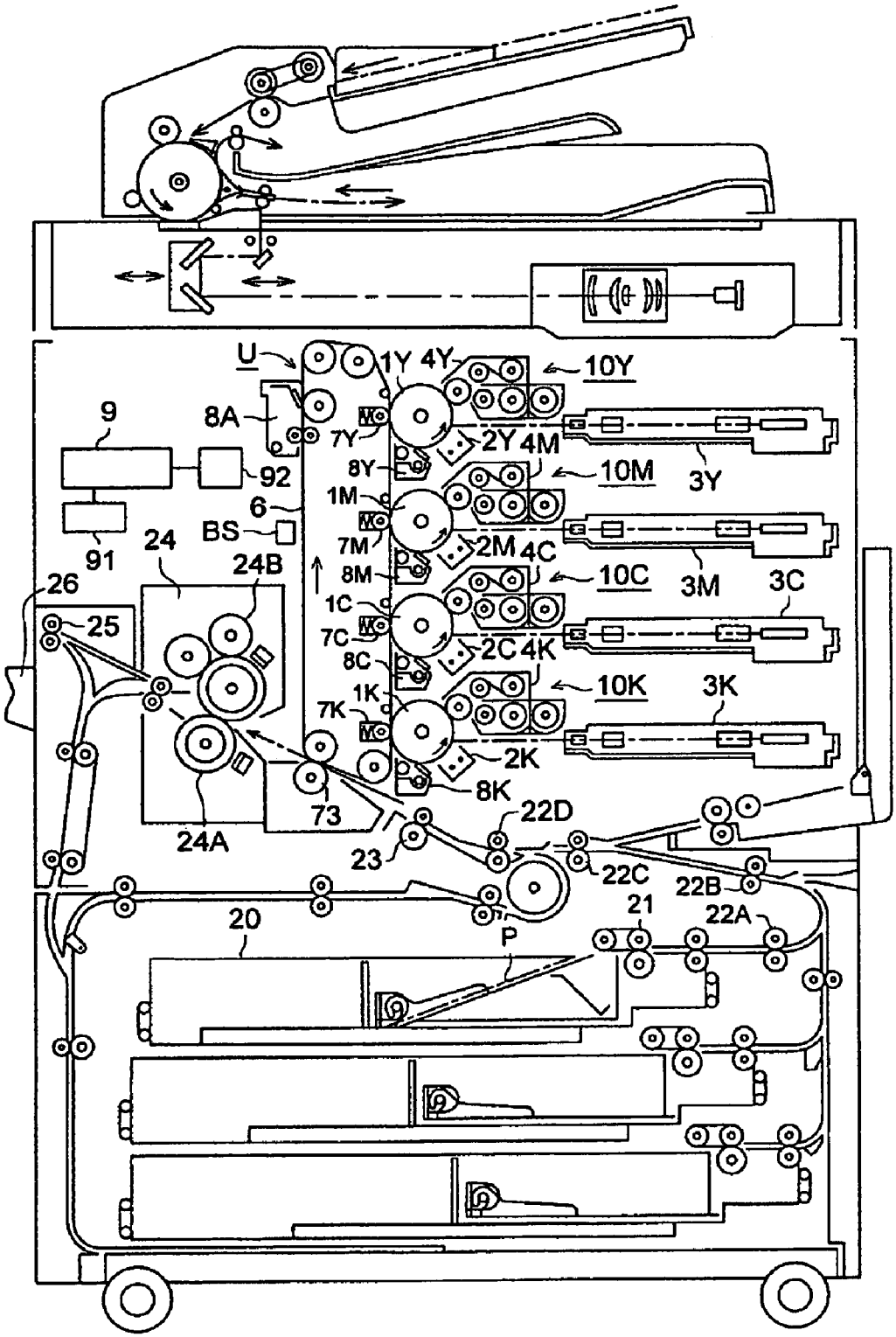
FIG. 1 shows a schematic structure of an image forming apparatus embodied in the present invention.

The embodiments of this invention will be described in the following with reference to the accompanying drawings. FIG. 1 shows the schematic structure of the image forming apparatus of an embodiment of this invention. The image forming apparatus of this invention has 4 photoreceptor drums which are the image bearing members, and represents the full color electrophotographic image forming apparatus which uses an intermediate transfer member. The following is a detailed description of the image forming apparatus of this invention. As shown in FIG. 1, this image forming apparatus has 4 image forming devices on the periphery of the photoreceptor drum which is the image bearing member, and each is made up of devices such as a charging device, an exposing device, a developing device, a cleaner. The images on the photoreceptor drum which are formed at the image forming devices are sequentially transferred onto the intermediate transfer members which move and pass adjacent to the photoreceptor drum in the first transfer section, and the images that have been transferred to the intermediate transfer member are further transferred to a recording medium such as paper in the second transfer section.

The following is the detailed description of the image forming device of this embodiment. The 4 image forming devices 10Y, 10M, 10C and 10K which form the images of the colors yellow, magenta, cyan and black have the photoreceptor drums 1Y, 1M, 1C and 1K respectively, and the photoreceptor drums rotate in the direction of the arrow (counter-clockwise). Furthermore, the charging devices 2Y, 2M, 2C and 2K, exposing devices 3Y, 3M, 3C and 3K, developing devices 4Y, 4M, 4C and 4K, and cleaners 8Y, 8M, 8C and 8K are sequentially arranged along the periphery of the photoreceptor drums 1Y, 1M, 1C and 1K respectively in the direction of rotation of the photoreceptor drum.

Figure 2:
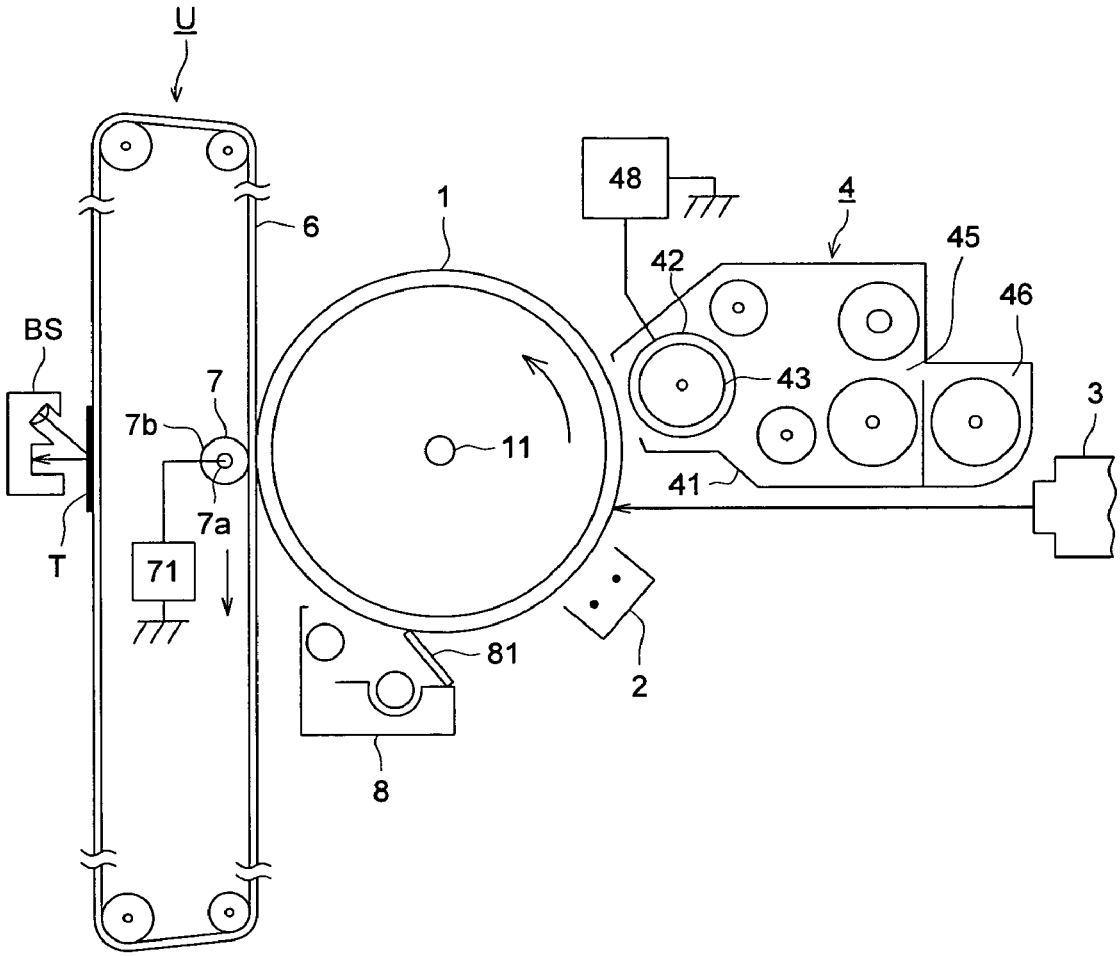
FIG. 2 shows a structure of an image forming device shown in FIG. 1.

The following is the detailed description of the image forming device using FIG. 2. The 4 image forming devices have the same structure. The letters Y, M, C and K have been omitted in this description. This image forming device is made up of a photoreceptor drum 1 which is supported so as to be rotatable by a device body which is not shown, as the image bearing member. The photoreceptor drum 1 is a cylindrical electrophotographic photoreceptor which has the basic components of a conductive base made of aluminum or the like and a photoconductive layer formed on the outer periphery thereof. There is a support axle 11 at the center of the photoreceptor drum 1 and the photoreceptor drum 1 is driven so as to rotate around the support axle 11 in the direction of the arrow by a driving device that is not shown.

In FIG. 2, a charging device 2 is disposed diagonally under the photoreceptor drum 1. The charging device 2 evenly charges the surface of the photoreceptor drum 1 with a fixed polar electric potential. As a result, the surface of the photoreceptor drum 1 is evenly charged.

An exposing device 3 is disposed at the downstream side of the charging device 2 in the direction of rotation of the photoreceptor drum 1. The exposing device 3 forms electrostatic latent images on the photoreceptor drum 1, based on the image information using laser beams. A developing device 4 which is disposed at the downstream side of the exposing device 3 has a developing container 41 for storing the developing agent and a developing sleeve 42 is disposed so as to be rotatable inside the opening facing the photoreceptor drum 1 of the developing container 41. In the developing sleeve 42, a magnet roller 43 which carries the developing agent on the developing sleeve 42, is fixed so as not to rotate with the rotation of the developing sleeve 42. The developing agent is a two-component developing agent formed from a toner and a carrier. In addition, the developing container 41 has a developing chamber 45 and a mixing chamber 46 which are partitioned. Developing bias is applied to the developing sleeve 42 by a power source 48, and toner images are thereby formed on the photoreceptor drum 1.

The side of the photoreceptor drum 1 at the downstream side of the developing device 4 has a transfer roller 7 which is the transfer device. The transfer roller 7 is made up of a core 7*a* and a conducting layer 7*b* which is on the outer peripheral surface thereof. The transfer roller 7 is urged toward the photoreceptor drum 1 by a pressing member and the conducting layer 7*b* is pressed to contact the surface of the photoreceptor drum 1 via an intermediate transfer member 6 using a predetermined pressing force and a transfer nip section is formed. The belt-like intermediate transfer member 6 is nipped to the transfer nip section, and the toner image on the photoreceptor drum 1 is transferred to the surface of intermediate transfer member 6 by the transfer bias applied from a power source 71. In addition, an optical density sensor BS is provided so as to oppose the intermediate transfer member 6.

Substances such as residual toner adhering to the photoreceptor drum 1 after the toner image has been transferred are removed using a cleaner 8. A cleaner blade 81 is caused to contact the photoreceptor drum 1 at a predetermined angle and with a predetermined pressing force using a pressing device which is not shown.

In FIG. 1, an intermediate transfer member unit U is disposed at the side of the photoreceptor drums. The intermediate transfer member unit U has the intermediate transfer member 6 and primary transfer rollers 7Y, 7M, 7C and 7K and a secondary roller 73, as well as an intermediate transfer member cleaner 8A.

In the image forming apparatus described above, the toner images formed on the photoreceptor drums 1Y, 1M, 1C and 1K receive transfer bias from the opposing primary transfer rollers 7Y, 7M, 7C and 7K which nip the intermediate transfer member 6 and are sequentially transferred onto the intermediate transfer member 6, and then conveyed to the secondary transfer roller 73 as the intermediate transfer member rotates.

Meanwhile, on the other hand, the recording materials P which have been taken out from a paper feeding cassette 20 are fed to conveying rollers 22A, 22B, 22C, and 22D, and a resist roller 23 via a pickup roller 21, and then conveyed to the left of the figure, and the aforementioned toner images are transferred onto the recording material P by the secondary transfer bias applied to the secondary transfer roller 73. It is to be noted that the toner and the like remaining on the intermediate transfer member 6 after transfer is removed by an intermediate transfer member cleaner 8A.

A fixing device 24 is made up of a fixing roller 24A which is disposed so as to rotate, and a pressing roller 24B which rotates while pressing onto the fixing roller 24. The recording material P is subjected to heat-fixing when it passes between the fixing roller 24A and the pressing roller 24B, and a full color image is formed on the recording material P, and the recording material P is discharged to a tray 26 by a paper conveying roller 25.

It is to be noted that the intermediate transfer member 6 is belt-like and is formed of a conductive resin such as PC or PET, but may be formed of other materials. Also, the outer diameter of the primary transfer rollers 7Y, 7M, 7C and 7K is $\phi$, 20 mm and are formed from NBR (acrvlo-Nitrile Butadiene Rubber) conductive sponge rubber and the hardness is 25° and the resistance is $1 \times 10^9 \Omega$.

Figure 3:
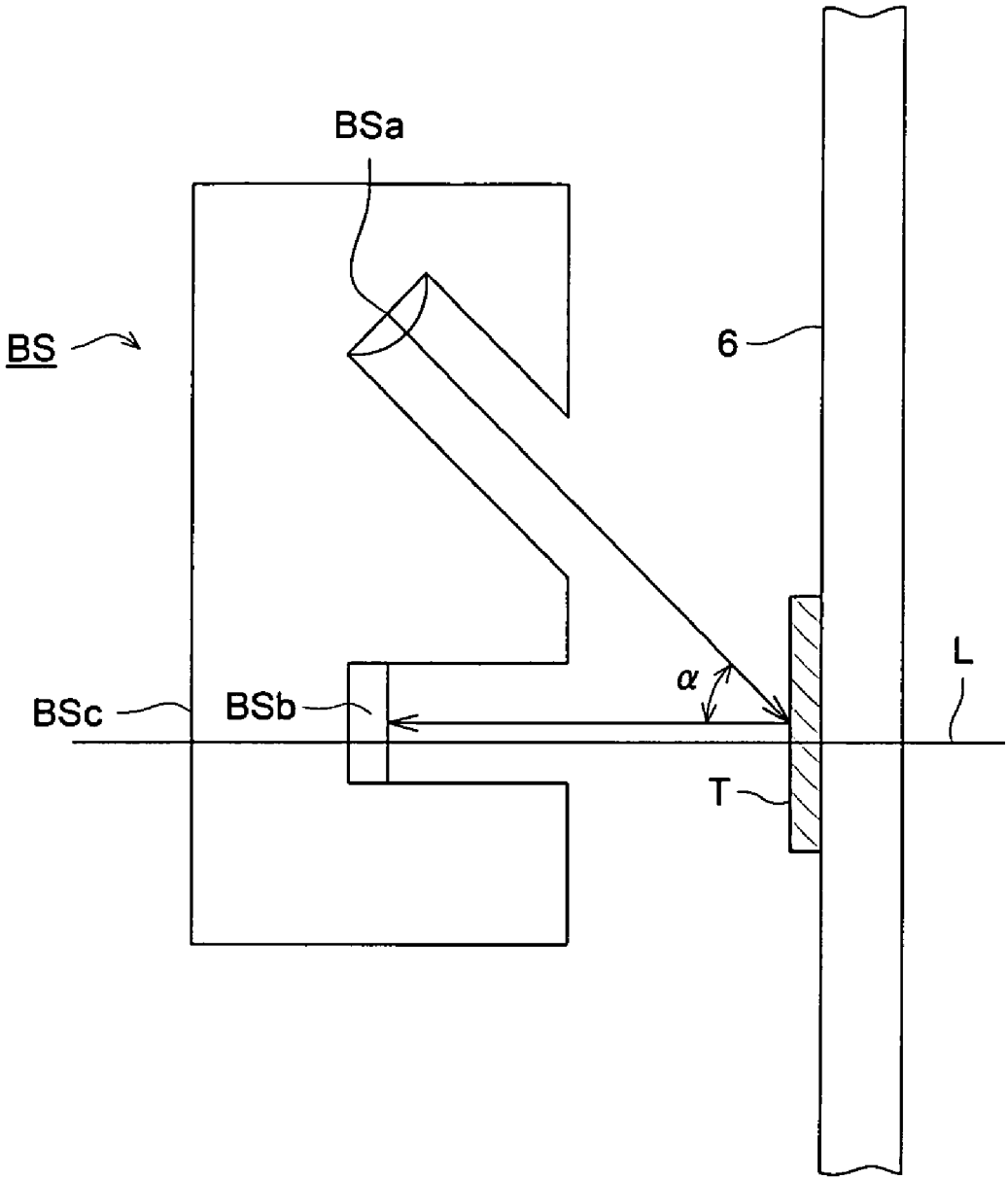
FIG. 3 shows a pattern diagram of an optical density sensor for detecting density of a toner patch image used for control in this embodiment.

A pattern diagram of the optical density sensor BS which detects the density of the toner patch image used for control in the embodiment is shown in FIG. 3. The optical density sensor BS is disposed so as to oppose the intermediate transfer member 6 and made up of an optical element BSa such as LED, a light receiving element BSb such as photodiode and a holder BSc, and the infrared light from the light receiving element BSb is irradiated onto the toner patch image of the intermediate transfer member 6, and the density of the toner patch image is measured by measuring the light reflected from said toner patch image at the light receiving element BSb. If a dimension L is used as the reference in the optical density sensor BS such that the straight reflection from the toner patch image T is not irradiated onto the light receiving element BSb, the angle of radiation for the toner patch image T is $\alpha$=45° and the light receiving angle of the light reflected from the toner patch image T is 0° and only the irregular reflection angle is measured.

As shown in FIG. 1 and FIG. 2, the image forming apparatus of this embodiment is made up of an image bearing member 1; a charging device 2 for charging the image bearing member 1; an exposing device 3 for exposing the image bearing member; and the developing device 4 for developing the exposed image bearing member and forming toner images and a transfer device for transferring the toner image onto the intermediate transfer member by applying the transfer bias from the power source in the transfer section. The image forming apparatus also has an image stabilization controlling section 91 which controls image stabilization so as to keep the density of a halftone toner image formed on the intermediate transfer member 6 within a predetermined range, a transfer output control section 92 which performs transfer output control by controlling transfer output optimally based on the density of the toner patch image on the intermediate transfer member, and a controlling section 9 which controls transfer output control section 92 and the image stabilization controlling section 91. In addition, the controlling section 9 performs the image stabilization controlling operation so as to precede the transfer output controlling operation.

Figure 4:
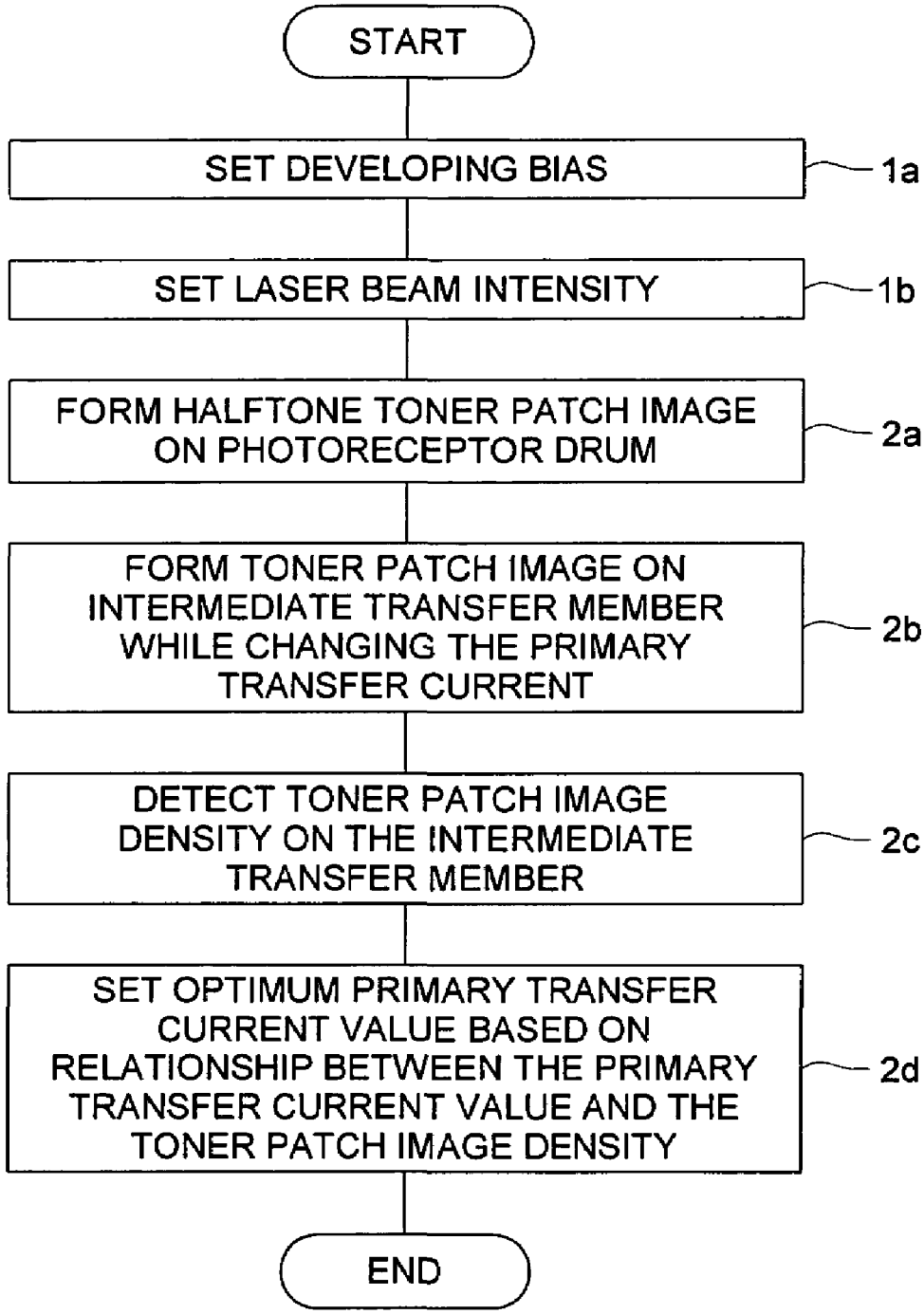
FIG. 4 is a flowchart showing a flow of a transfer output operation of the image forming apparatus embodied in the present invention.

The method for performing the image stabilization controlling operation so as to precede the transfer output controlling operation in the controlling section which is a feature of this invention is shown in the flowchart which shows the flow of the control operation of the transfer output for the image forming apparatus in FIG. 4.

First, a provisional primary transfer current value is determined before performing the image stabilization controlling operation. More specifically, the relationship between the density of the toner patch image and the primary transfer current value is determined in advance and the provisional primary transfer current value $I_0$ is set to 30 μA, for example, based on the relationship data.

(Image Stabilization Control)

First in step S1*a*, the value of the developing DC bias (also, called developing bias) Vdc is determined by the D-max correction method for performing correction such that a predetermined high density image is formed based on the maximum density of the document. More specifically, with the aforementioned provisional primary transfer current value $I_0$ as the initial value, a halftone toner patch image is formed on the intermediate transfer belt, and the toner patch image is read by the optical density sensor BS (See FIG. 3), and based on the output, the developing DC bias Vdc is set so as to reach a predetermined high density. It is to be noted that the charge potential Vh is set to a value for which a margin is added to the developing DC bias Vdc.

Next, in Step 1*b*, the laser beam intensity (also referred to as laser power) of the exposing device is set so that the electric potential of the intermediate adjusting density of the image bearing member will be within a certain range. It is to be noted that the structure may also be such that the light emitting time of the laser is set. In these steps S1*a* and S1*b*, even if the changes in the properties of the transfer roller and the intermediate transfer member that are used, changes in the physical properties of the toner, and changes in the properties of the photoreceptor cause the image density to change, the density of more than one toner image on the intermediate transfer member can be kept within a fixed range.

(Transfer Output Control)

Next, in Step 2*a*, more than one halftone toner patch image are formed on the photoreceptor drum 1 which is the image bearing member.

Next, in Step 2*b*, toner patch images on the photoreceptor drum 1 are transferred onto the intermediate transfer member while changing the primary transfer current value to $I_1, I_2 \ldots I_{J-1}, I_J \ldots I_N$.

Next, in Step 2*c*, the density of the toner patch image(s) on the intermediate transfer member is detected by the optical density sensor BS.

Next in Step 2*d*, the optimum value for the primary transfer current (transfer output value) is set based on the relationship between the primary transfer current value and the optical density of the toner patch image(s).

Figure 5:
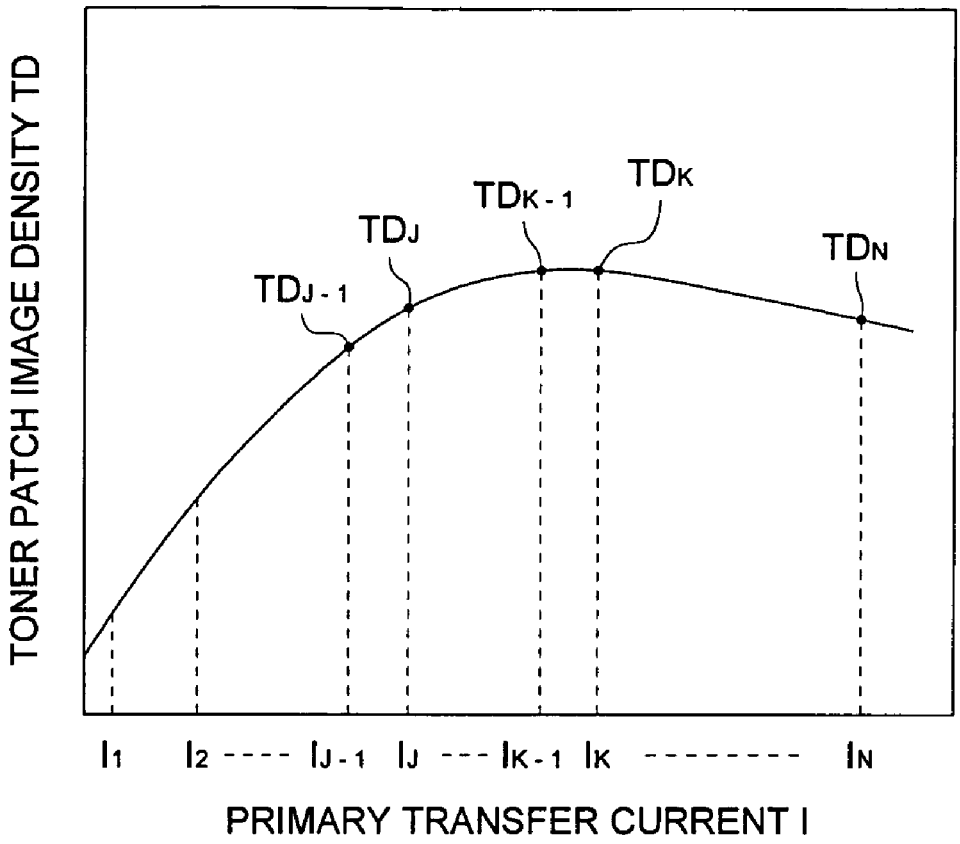
FIG. 5 shows a relationship between the primary transfer current and the density of the toner patch image.

In this embodiment, if the optical density for the toner patch image when the primary current value is $I_J$, when $TD_J \leqq TD_{J-1}$, that is to say, when the primary transfer current value is $I_K$ in a vicinity of maximum density of the optical density of the toner patch image is $I_K$, $I_K$ is set as the primary transfer current value of the toner image. This relationship is shown in FIG. 5. FIG. 5 is an explanatory diagram for obtaining the relationship between the primary transfer current I and the toner patch image density TD and the optimum first transfer current.

The effect on toner image density of the difference between the provisional primary transfer current value $I_0$ and the final primary transfer current value $I_k$ will now be described. Concerning the relationship between the primary transfer current when the toner image on the image bearing member is transferred to the intermediate transfer member and the transfer efficiency for transfer of the image bearing member having the toner image to the intermediate transfer member, it is noted that when the primary transfer current value is increased, the transfer efficiency also increases, but the change ratio of transfer efficiency for the primary transfer current value gradually decreases and image defects begin to appear at the boundary of maximum transfer efficiency and the transfer efficiency gradually undergoes a tendency to decrease.

In this invention, by performing the image stabilization control operation, the provisional primary transfer current value $I_0$ is set in the vicinity of the maximum transfer efficiency, and thus even if adjustment of the primary transfer current value (transfer output control) is subsequently conducted in the vicinity of that current value, there is no such great change in the transfer efficiency as described above. Thus, the toner image density which shows the same tendencies as transfer efficiency also does not undergo any great changes, and when the provisional primary transfer current value $I_0$ is set in the vicinity of the maximum transfer efficiency, there is little effect on the toner image density due to the difference between the provisional primary transfer current value $I_0$ and the final value of the primary transfer current value $I_k$ that is obtained.

As described above, according to this invention, the transfer output can be accurately obtained, and in particular, even if there are such changes as in the properties of the transfer roller and the intermediate transfer member that are used, in the physical properties of the toner, and in the properties of the photoreceptor which are due to environmental changes (for instance in temperature) and the passage of time, accurate transfer output can be obtained, and high quality images can be output.

Figure 6:
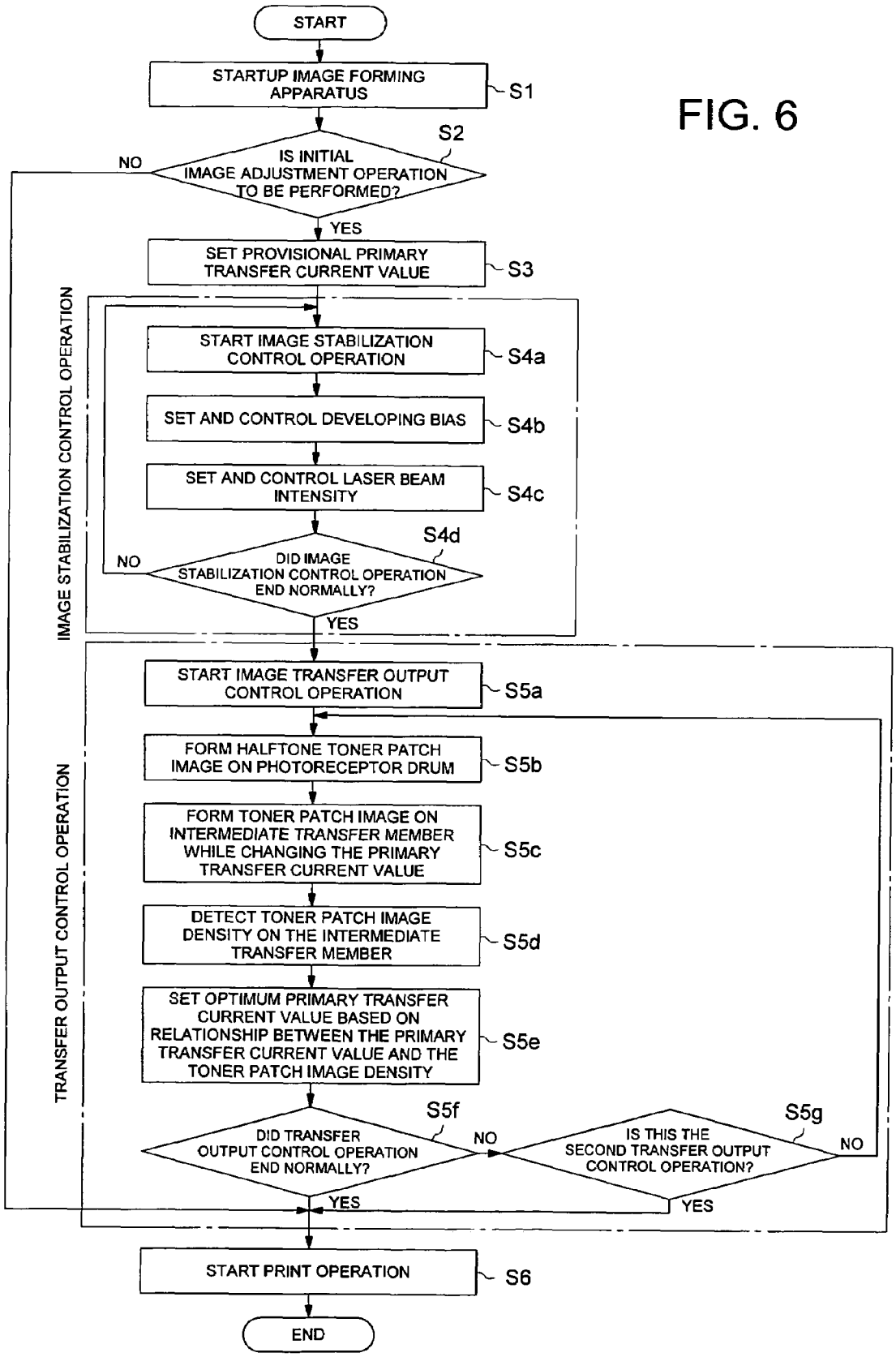
FIG. 6 is a flowchart showing a flow of a controlling operation for performing adjustment in an idling mode.
Figure 7:
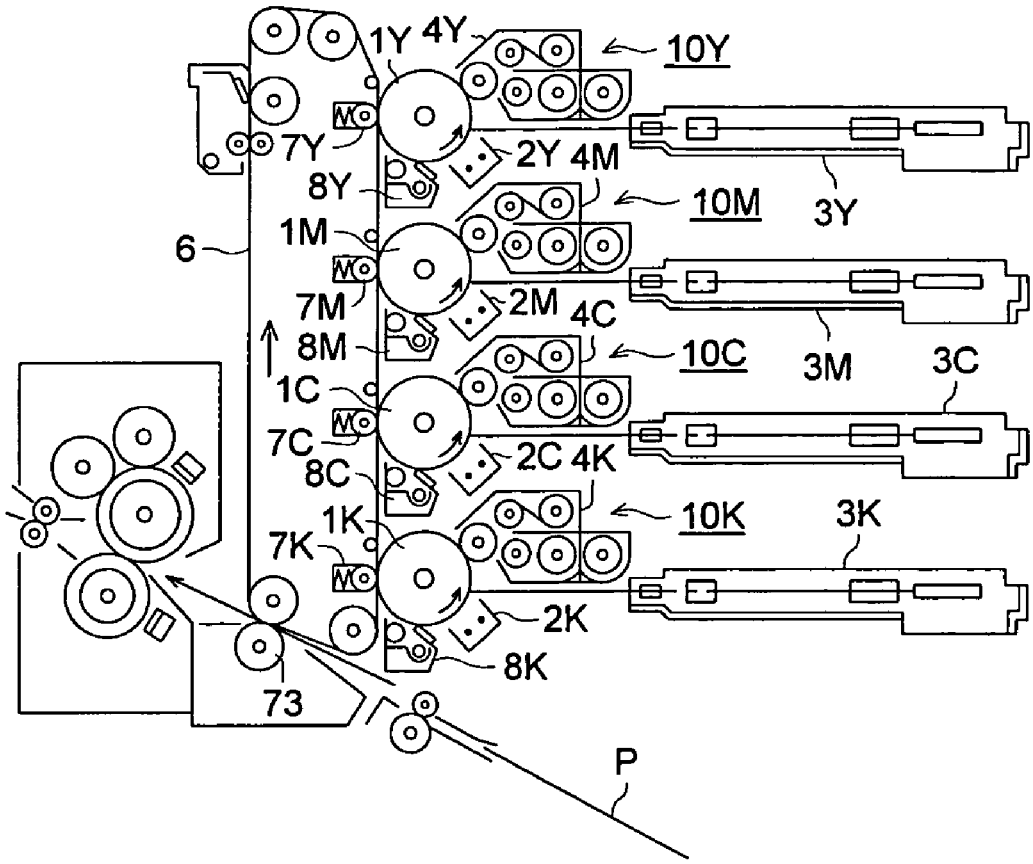
FIG. 7 shows a schematic structure of a conventional image forming apparatus.

Next, an example in which the adjustment control operation for image density of this invention is used in an idling mode will be described. It is to be noted that the adjustment control operation performed when a predetermined number of copies is reached is also the same. FIG. 6 is a flowchart showing the flow of the control operation for performing such adjustment in the idling mode.

As shown in FIG. 6, in Step S1, the image forming apparatus is started. Next in Step S2, checking is done to determine whether the initial image adjusting operation is to be performed. For example a check is done to determine whether it is the first operation of the morning whereby the device was stopped after the image forming apparatus was used and then is being restarted the following morning. This is done by checking if the image forming apparatus has not been in operation for 8 or more continuous hours, and if an adjustment is to be made (YES), the operation proceeds to Step S4, while if no adjustment is to be made (NO), the print operation of step S6 is started.

Next, the provisional primary transfer current is set in Step S3.

The image stabilization control operation is started in Step S4. Steps S4*b* and S4*c* are the same as Steps S1*b* and S1*c* shown in FIG. 4.

In Step S4*d*, a determination is made as to whether the image stabilization control operation ended normally, and in the case where it did not end normally (NO), the operation returns to Step S4*a* and the operation from Step S4*a* to Step S4*c* is performed, while if the operation ended normally, it proceeds to Step S5*a*.

Next in Step S5*a*, the transfer output control operation is started. The operation from Step S5*b* to Step S5*e* is the same as that Step S2*a* to Step S2*d* in FIG. 4.

In Step S5*f*, a determination is made as to whether the transfer output control operation has ended normally, and in the case where it did not end normally (NO), the operation proceeds to Step S5*g*, while if it ended normally (YES), the operation proceeds to Step S6.

In Step S5*g*, a determination is made as to whether the transfer output control operation is the second one, and if so (YES), the operation proceeds to Step S6, but if not it returns to Step S5*b* and the operation from Step S5*b* to Step S5*e* is repeated. Finally, in Step S6, the print operation is started.

As described above, the transfer output is accurately obtained, and in particular, even if there are such changes as in the properties of the transfer roller and the intermediate transfer member that are used, in the physical properties of the toner, and changes in the properties of the photoreceptor due to environmental changes and the passage of time, transfer output is accurately obtained, and high quality images are output.

It is to be noted that the embodiment in which the order is such that the image stabilization controlling operation precedes the transfer output controlling operation is described, and provided that this order is not changed, other control operations may be inserted before, after or between these steps.

Also, in this embodiment, an image forming apparatus has been described in which toner images are formed on more than one image bearing member and transferred to the intermediate transfer member and then transferred to the recording material, but the invention is not limited thereto. For example, an image forming apparatus in which the image bearing members are replaced by a single image bearing member, and the intermediate transfer member is replaced by a drum-like intermediate transfer member can be suitably used. Also, a multiple development intermediate transfer method may be used in which toner images are sequentially formed on the same image bearing member, and these toner images are transferred to the intermediate transfer member and after the toner images are superposed, the superposed toner images are transferred together onto the recording material.

While the preferred embodiments of the present invention have been described using specific term, such description is for illustrative purpose only, and it is to be understood that changes and variations may be made without departing from the spirit and scope of the appended claims.

What is claimed is:

1. An apparatus for forming an image, comprising:

an image bearing member;

a charging device to charge said image bearing member; an exposing device to expose said image bearing member charged by said charging device so as to form a latent image on said image bearing member;

a developing device to develop said latent image so as to form a toner image on said image bearing member;

a transferring device to transfer said toner image onto an intermediate transfer member at a transferring section by applying a transfer bias voltage outputted by a power source;

an image stabilization controlling section to conduct an image stabilization controlling operation for keeping a density of said toner image transferred onto said intermediate transfer member within a predetermined range;

a transfer output controlling section to conduct a transfer output controlling operation for controlling a transfer output based on a density of a toner patch image formed on said intermediate transfer member; and an overall controlling section to control both said image stabilization controlling section and said transfer output controlling section, in such a manner that said image stabilization controlling operation is conducted preceding to said transfer output controlling operation.

2. The apparatus of claim 1, wherein said transfer output controlling section transfers toner patch images formed on said image bearing member onto said intermediate transfer member while changing said transfer output of said transferring device and controls said transfer output based on said densities of said toner patch images detected on the intermediate transfer member.

3. The apparatus of claim 2, wherein said transfer output controlling section obtains said transfer output value corresponding to a vicinity of maximum density among densities of said toner patch images formed on said intermediate transfer member.

4. The apparatus of claim 1, wherein said image stabilization controlling section controls a developing bias voltage, based on densities of toner patch images formed on said intermediate transfer member.

5. The apparatus of claim 1, wherein said image stabilization controlling section controls an intensity or a light emitting time of a laser beam emitted by a light emitting element equipped in said exposing device so as to keep an electric potential of a halftone toner image formed on said image bearing member within a predetermined range.

6. The apparatus of claim 1, wherein said transfer output controlling operation is conducted at a time when a predetermined environmental condition is changed or a predetermined time has passed.

7. The apparatus of claim 1, wherein said overall controlling section conducts a constant current controlling operation for controlling a current value of said transfer output.

8. The apparatus of claim 1, wherein a developing agent to be employed in said developing device is a two component developing agent including toner and carrier.

* * * * *